United States Patent [19]

Dittmann

[11] Patent Number: 4,683,358

[45] Date of Patent: Jul. 28, 1987

[54] CONTACT ARRANGEMENT IN A RELAY FOR HIGH BREAKING CAPACITY

[75] Inventor: Michael Dittmann, Berlin, Fed. Rep. of Germany

[73] Assignee: Siemens Aktiengesellschaft, Berlin and Munich, Fed. Rep. of Germany

[21] Appl. No.: 833,226

[22] Filed: Feb. 26, 1986

[30] Foreign Application Priority Data

Mar. 5, 1985 [DE] Fed. Rep. of Germany ... 8506345[U]

[51] Int. Cl.[4] ..... H01H 1/20

[52] U.S. Cl. ..... 200/243; 200/271; 200/275

[58] Field of Search ..... 200/275, 243, 244, 245, 200/246, 247, 271, 283

[56] References Cited

U.S. PATENT DOCUMENTS

| | | | |
|---|---|---|---|
| 2,263,090 | 11/1941 | Humphreys et al. | 200/243 |
| 2,597,368 | 5/1952 | Page | 200/244 |
| 3,299,239 | 1/1967 | Mawney et al. | 200/275 |
| 3,344,248 | 9/1967 | Cusick | 200/82 B |
| 3,757,069 | 9/1973 | Reuting | 200/275 |
| 3,930,211 | 12/1975 | Belttary | 200/246 |
| 4,250,367 | 2/1981 | Rossi | 200/275 |
| 4,517,537 | 5/1985 | Weiser et al. | 335/187 |

FOREIGN PATENT DOCUMENTS

| | | | |
|---|---|---|---|
| 0046148 | 2/1982 | European Pat. Off. . | |
| 0081164 | 11/1982 | European Pat. Off. . | |
| 2031025 | 12/1971 | Fed. Rep. of Germany | 200/283 |
| 8109089 | 7/1981 | Fed. Rep. of Germany . | |
| 2927879 | 9/1982 | Fed. Rep. of Germany . | |
| 8325986 | 4/1983 | Fed. Rep. of Germany . | |
| 8134890 | 5/1983 | Fed. Rep. of Germany . | |
| 3431909 | 3/1986 | Fed. Rep. of Germany | 200/245 |

*Primary Examiner*—Stephen Marcus
*Assistant Examiner*—Renee S. Luebke
*Attorney, Agent, or Firm*—Hill, Van Santen, Steadman & Simpson

[57] ABSTRACT

A contact arrangement for a relay having a high breaking current capacity. A contact spring is split in fork-like fashion so as to form two fork ends at its free end. The contact spring is opposite two cooperating contact elements in the form of a double contact or two contacts to be bridged. The two fork ends of the contact spring are directly connected to one another via a welded on contact strip. A stranded conductor is welded directly to a freely accessible center portion of the contact strip between the two fork ends. Thus, the two contacting locations of the contact spring are connected to one another or to a power terminal in a low-loss fashion without employing an expensive central contact spring having good conductivity. Rather, a spring steel having a relatively poor conductivity may be employed.

9 Claims, 5 Drawing Figures

100
1
2
2a
12
6
4
9
9b
11a
11
5
2b
9a
III
3
8
7
10

CONTACT ARRANGEMENT IN A RELAY FOR HIGH BREAKING CAPACITY

BACKGROUND OF THE INVENTION

The invention relates to a contact arrangement in a relay for high breaking capacity comprising a movable contact spring which is split in fork-like fashion into two ends at its free end. Each of these fork ends is opposite a stationary cooperating contact element at at least one side.

Such a relay is disclosed, for example, by German Utility Model No. 81 34 890, corresponding to U.S. Ser. No. 433,837, filed Oct. 12, 1982, incorporated herein by reference. In general terms, contact springs having split ends for double contacting have been standard for a long time in order, for example, to enhance the contact reliability, given weak current contacts. Given relays with which high powers are switched, a contact spring having double contacts serves either as a bridge contact without its own terminal, or the current path is divided via two contacts as a parallel circuit in order to divide the high switching current onto the conductive cross-section of two terminal elements, and to thus protect these against excessive heating. In both of these instances, however, the contact arrangements have hitherto been designed such that the full switching current flows over the spring. In order to keep the voltage drop and the heating low, the contact spring must therefore be formed of material having good electrical conductivity. On the other hand, such a spring must also exhibit defined elastic properties in order to guarantee the required switching characteristic and the contacting forces. In order to meet all of these demands, thus the contact spring must be produced of an expensive copper alloy.

Given simple contacts, it has in fact been known to directly conduct the current from a terminal element to the contact location via a stranded copper conductor, whereby the stranded copper conductor was directly connected to the contact member (German UM No. 81 09 089 and German Pat. No. 29 27 879, both incorporated herein by reference). For a contact spring comprising an end split in fork-like fashion wherein each of these ends carries a contact member, this known type of direct contacting would mean twice the expense.

SUMMARY OF THE INVENTION

An object of the invention is to create a contact arrangement for a relay of the type initially cited whereby a high switching current can be conducted via the two fork ends of the contact spring, both when employed as a bridge contact, as well as when employed as a double contact without the contact spring itself having to be formed of material exhibiting good electrical conductivity. Thus, a simple current feed to the two fork ends is nonetheless possible.

This object is inventively achieved in that both fork ends are connected via a contact strip of material exhibiting good electrical conductivity which is at a right angle relative to the longitudinal extent of the contact spring and lies free in the region between the fork ends.

In a development of the invention, the contact strip itself can be fashioned as a continuous contact member which is opposite the two cooperating contact elements. This contact member can, for example, be formed of copper or of a copper alloy. The strip is preferably coated with an additional precious metal coating, at least in the regions opposite the cooperating contact elements. In another embodiment, however, the contact strip itself can be formed of a precious metal alloy, for example of silver-nickel or the like, so that an additional coating is not necessary.

Since a portion of the contact strip lies free and unobstructed in the region between the two fork ends of the contact springs, a stranded lead can be easily welded directly to the contact strip directly in this region. Thus, the supplied switching current does not proceed via the contact spring itself at all, given employment for double contacting. This contact spring accordingly can be designed based only on its spring properties, and thus can be fashioned as spring steel having a relatively poor electrical conductivity as compared to the stranded lead. The stranded lead welded in the central region is also not disturbing when the fork ends of the contact spring are to be provided with contact members for producing a double switchover contact. The individual contact members residing opposite the contact strip can be directly connected to the contact strip in respective clearances of the spring material, so that the resistance of the spring likewise plays no part in the current path of the switching current.

The inventively designed contact spring comprising fork ends, however, can also be utilized as a bridge contact, whereby the contact strip itself represents the contact bridge. In this case, the contact strip need not be designed in solid fashion. On the contrary, a flexible stranded conductor can also be employed for this purpose, the ends thereof being welded to the fork ends of the contact spring. This has the advantage that the two fork ends are not rigidly connected to one another. Thus, for example, when the one fork end bonds, the other can still be moved and open the contact under given conditions.

DESCRIPTION OF THE PREFERRED EMBODIMENTS

Figure 1:
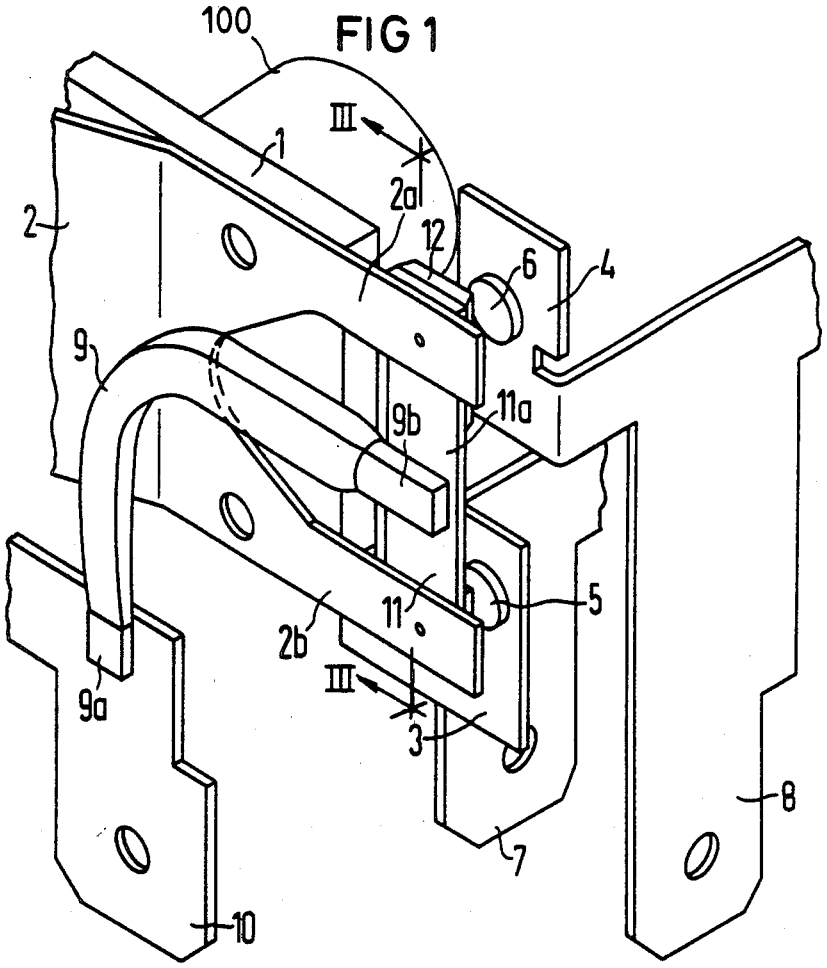
FIG. 1 is a perspective view of a contact arrangement of the invention and shown as a portion of a relay.

The contact arrangement shown in FIG. 1 is part of a relay as shown in general with its magnet system in, for example, German UM No. 83 25 986, incorporated herein by reference. A contact spring 2 is secured to the armature 1 actuated by a solenoid 100 of such a magnet system. This contact spring 2 also serves as an armature restoring spring. At its free end, the contact spring 2 is divided into two fork ends 2*a* and 2*b* which are opposite two cooperating contact elements 3 and 4, or opposite the contact members 5 and 6 situated thereon. As a consequence of the simultaneous contacting between the contact spring 2 or its ends 2*a* and 2*b* with the two cooperating contact elements 3 and 4, a high switching current is divided over two parallel paths and is diverted via two terminal lugs 7 and 8 which are anchored in a base body (not shown). Excessively high heating of the current-carrying parts is thus avoided.

The current feed to the contact spring 2 occurs via a stranded conductor 9 which has one end 9*a* connected, for example by welding, to a terminal element 10. It has its other end 9*b* welded to a contact strip 11 laid over the two fork ends 2*a* and 2*b* perpendicular to the longitudinal direction of the contact spring 2. It is secured to these fork ends 2*a* and 2*b* by means of welding, riveting, or the like. At the same time, the contact strip 11 serves as a contact member which is also provided with an additional precious metal coating 12 in the actual contacting regions opposite the contact members 5 and 6. The exposed center portion 11*a* of the contact strip 11 in the cut-out region between the fork ends 2*a* and 2*b* of the contact spring 2 enables a simple welded attachment of the stranded conductor 9, whereby the switching current is directly supplied to the contact member 11 and thus does not proceed via the contact spring 2 itself. This contact spring 2 can therefore be formed of relatively inexpensive spring steel which has poor electrical conductivity.

Figure 2:
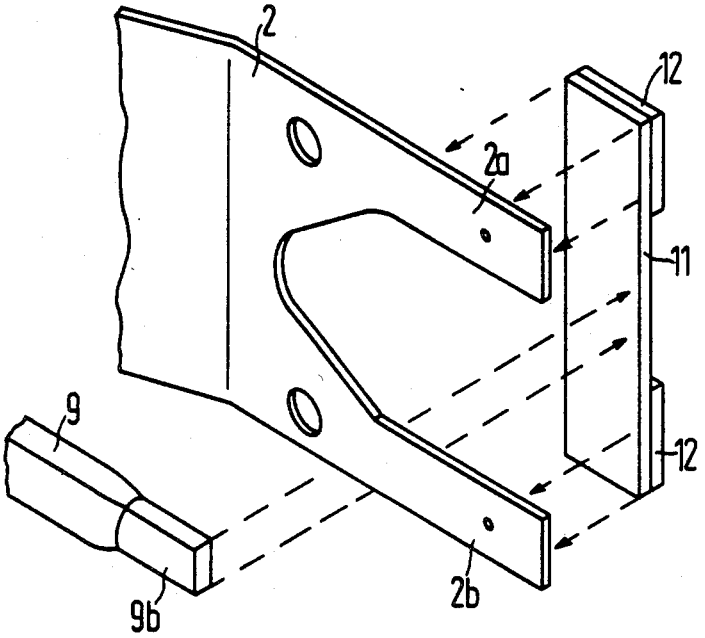
FIG. 2 is a detailed perspective illustration of a free end of the contact spring of FIG. 1 and having a contact strip to be applied thereto.
Figure 3:
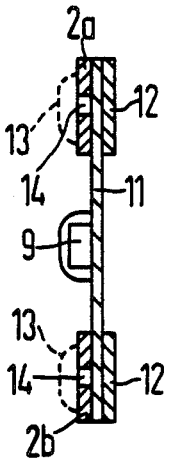
FIG. 3 is a sectional view through the contacting end of the contact spring along line III—III of FIG. 1.

The application of the contact strip 11 to the fork ends 2*a* and 2*b* of the contact spring 2, and the welding of the stranded conductor 9 at its end 9*b*, may be seen in the enlarged illustration of FIG. 2. In a sectional view through the spring ends 2*a* and 2*b*, FIG. 3 shows the connection of the current-carrying parts.

The contact spring 2 could also be fashioned as a double switch-over contact spring. In this case, additional contact members 13 would merely have to be applied to the fork ends 1*a* and 2*b* lying opposite the contact strip 11, as indicated with broken lines in FIG. 3. These additional contact members 13 could then cooperate with further cooperating contact elements (not shown). In this case, the current feed via the stranded conductor 9 would not have to be modified at all, since it is welded to the central region 11*a* of the contact strip 11, and thus does not conflict with the additional contact members 13. In order to assure a good current conduction without noteworthy contact resistance from the stranded conductor 9 via the contact strip 11 to the contact members 13 in this case as well, it is also preferable in this case to provide the contact members 13 with stems 14 which are situated in clearances of the fork ends 2*a* and are directly welded to the contact strip 11, or are connected thereto in some other fashion.

Figure 4:
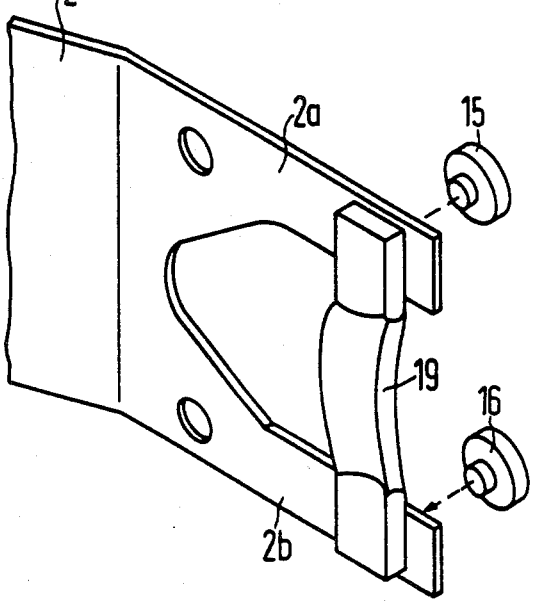
FIGS. 4 and 5 show in a perspective view and a cross-sectional view the free end of the contact spring in another embodiment of the invention.
Figure 5:
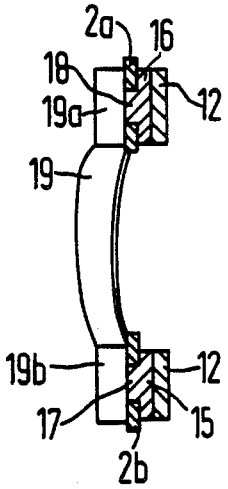

FIGS. 4 and 5 show a somewhat modified embodiment of the contact arrangement. As in the preceding embodiment, the contact spring 2 is provided with fork ends 2*a* which are opposite two cooperating contact elements 3 and 4 (see FIG. 1). In the case of FIGS. 4 and 5, however, the contact spring 2 is not provided with a current terminal at all. On the contrary, the contact spring acts as a contact bridge which closes the circuit between the two cooperating contact elements 3 and 4 when it is closed. In order to be able to manufacture the spring of poorly conductive spring steel in this case as well, and to nonetheless guarantee a low resistance, a contact band or tape 19 is situated between the fork ends 2*a* and 2*b*, this contact strip 19 being manufactured of a flexible stranded conductor. In this way, the two contact spring ends or fork ends 1*a* and 2*b* can execute a relative movement. Thus, if the contact at one fork end bonds, the contact at the other fork end is still movable, and can still be opened.

In this case, contact members 15 or 16 are arranged at both fork ends, these having stems 17 or 18 situated in clearances of the respective fork end and being respectively welded to the end 19*a* or 19*b* of the contact strip adjoining at the opposite side of the contact spring. In accordance with the preceding embodiment, the contact members 15 and 16 are provided with a contact coating 12 of precious metal. Of course, the overall contact members could also be formed of a precious metal alloy.

Although various minor changes and modifications might be proposed by those skilled in the art, it will be understood that I wish to include within the claims of the patent warranted hereon all such changes and modifications as reasonably come within my contribution to the art.

I claim as my invention:

1. A contact arrangement in a relay for high breaking current capacity, comprising:

a movable one-piece contact spring split in fork-like fashion into two integral fork ends at its free end;

each of said fork ends being opposite a fixed, stationary cooperating contact element at at least one side;

said two fork ends being connected to one another via a contact strip of material having relatively good electrical conductivity compared to the contact spring;

said contact strip having contact regions positioned near its opposite ends adjacent the fixed contact elements for electrical contact therewith and said contact strip extending perpendicular to a longitudinal extend of the fork ends of said contact spring and lying free and away from portions of the contact spring in a region between said fork end; and a flexible current carrying conductor connected at one end to said contact strip.

2. A contact arrangement according to claim 1 wherein said contact strip is opposite contact members mounted on two of said cooperating contact elements.

3. A contact arrangement according to claim 2 wherein each of said contact strip contact regions comprises a precious metal coating opposite said cooperating contact elements.

4. A contact arrangement according to claim 1 wherein said flexible current carrying conductor comprises a stranded conductor welded directly to a central region of said contact strip where it lies free in said region between said fork ends.

5. A contact arrangement according to claim 1 wherein said contact strip comprises a stranded conductor and has both ends welded to the fork ends at a side of said contact spring lying opposite cooperating contact elements at each fork end, contact strips being provided at said contact regions on said fork ends of said contact spring which directly connect to both said ends of said stranded conductor.

6. A relay for high breaking current capacity, comprising:

at least first and second fixed position, spaced apart relatively high current handling contacts;

a deflectable contact spring;

means for moving the contact spring;

said contact spring being shaped in fork-like fashion into two fork ends at a free end thereof;

each of the fork ends being positioned opposite said respective fixed position contact;

the contact spring including the fork ends being formed of a spring steel;

a contact strip of a material having a relatively good electrical conductivity compared to the spring steel contact spring, and being mounted between the two fork ends;

a respective cooperating contact layer on the contact strip positioned opposite each of the fixed contacts; and a flexible current carrying conductor having one end connected centrally of said contact strip.

7. A relay according to claim 6 wherein a conductivity of the flexible conductor is substantially higher than a conductivity of the spring steel contact spring.

8. A relay according to claim 6 wherein said contact strip extends perpendicular to a longitudinal extent of each of the fork-ends, and wherein said flexible current carrying conductor attaches to a free portion at one side of the contact strip substantially between the two fork ends and which is free of the contact spring so as to permit a welded attachment of the conductor centrally of the contact strip without obstruction from the contact spring.

9. A relay according to claim 8 wherein said contact layer opposite each fixed contact comprises a precious metal coating applied to the contact strip at a side opposite the welded attachment of the conductor.

* * * * *